US005167247A

United States Patent [19]

Belmonte

[11] Patent Number: 5,167,247

[45] Date of Patent: Dec. 1, 1992

[54] COMBINATION BAT AND UMBRELLA

[76] Inventor: Salvatore Belmonte, 208 Porterfield Pl., Freeport, N.Y. 11520-3119

[21] Appl. No.: 710,761

[22] Filed: May 31, 1991

[51] Int. Cl.[5] ..... A45B 3/00

[52] U.S. Cl. ..... 135/16; 135/44

[58] Field of Search ..... 135/16-19, 135/44, 34.2, 15.1, 33.2

[56] References Cited

U.S. PATENT DOCUMENTS

| | | | |
|---|---|---|---|
| 139,295 | 5/1873 | Chevers | 135/17 X |
| 169,406 | 11/1875 | Boyd | 135/17 |
| 372,177 | 10/1887 | Simmons | 135/16 X |
| 555,729 | 3/1896 | McGuire | 135/16 |
| 629,460 | 7/1899 | Nagell | 135/17 |
| 1,095,362 | 5/1914 | Swinland | 135/15.1 |
| 1,375,912 | 4/1921 | Huddle | 135/17 X |
| 2,164,242 | 6/1939 | Henry | 135/34.2 |
| 3,217,723 | 11/1965 | Suchy | 135/15.1 |
| 3,935,874 | 2/1976 | Cohen | 135/16 |
| 4,279,265 | 7/1981 | Tseng | 135/15.1 X |
| 4,543,971 | 10/1985 | Sirota | 135/16 |
| 4,597,400 | 7/1986 | Trudeau, Sr. | 135/18 |
| 4,962,779 | 10/1990 | Meng | 135/16 |

*Primary Examiner*—David A. Scherbel
*Assistant Examiner*—Lan Mai
*Attorney, Agent, or Firm*—Richard L. Miller

[57] ABSTRACT

A combination bat and umbrella is provided and consists of a collapsible canopy with a central rod extending from the canopy. A simulated baseball bat end affixed to the top of the canopy. A simulated baseball bat affixed to the bottom of the central rod. When the canopy is opened a person can comfortably grip the simulated baseball bat handle to position the canopy over themselves. When the canopy is closed it will look like a simulated baseball bat barrel to complete a simulated baseball bat configuration which can be used to ward off muggers and attackers.

4 Claims, 1 Drawing Sheet

COMBINATION BAT AND UMBRELLA

BACKGROUND OF THE INVENTION

The instant invention relates generally to umbrellas and baseball bats and more specifically it relates to a combination bat and umbrella.

Numerous umbrellas and baseball bats have been provided in the prior art that are adapted to be fabricated out of specific configurations. For example, U.S. Pat. No. 4,653,844 to Ping; U.S. Pat. No. 4,687,012 to Schultes et al. and U.S. Pat. No. 4,714,251 to Cook all are illustrative of such prior art. While these units may be suitable for the particular purpose to which they address, they would not be as suitable for the purpose of the present invention as hereafter described.

SUMMARY OF THE INVENTION

A primary object of the present invention is to provide a combination bat and umbrella that will overcome the shortcomings of the prior art devices.

Another object is to provide a combination bat and umbrella that is camouflaged to look like a baseball bat so as to ward off muggers and attackers when in the need to.

An additional object is to provide a combination bat and umbrella in which the handle is more comfortable to hold when the device is used as an opened umbrella.

A further object is to provide a combination bat and umbrella that is simple and easy to use.

A still further object is to provide a combination bat and umbrella that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
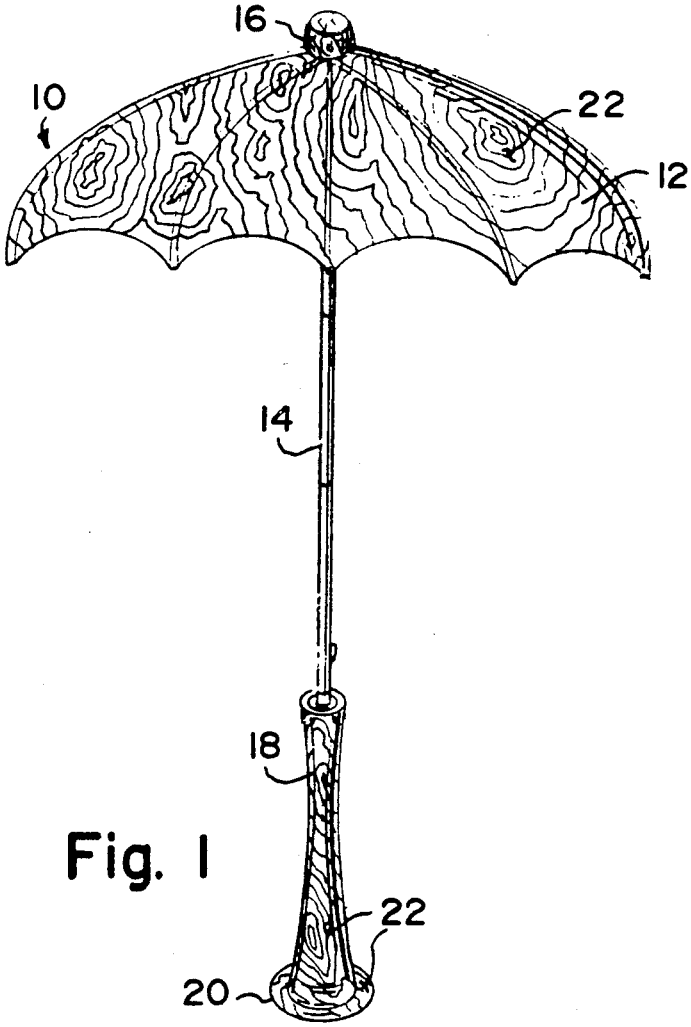
FIG. 1 is a perspective view of the instant invention in an opened position.
Figure 2:
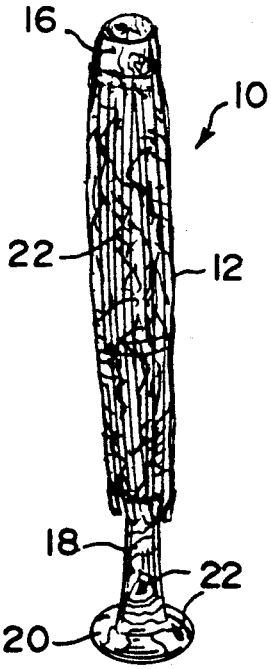
FIG. 2 is a perspective view of the instant invention in an closed position.
Figure 3:
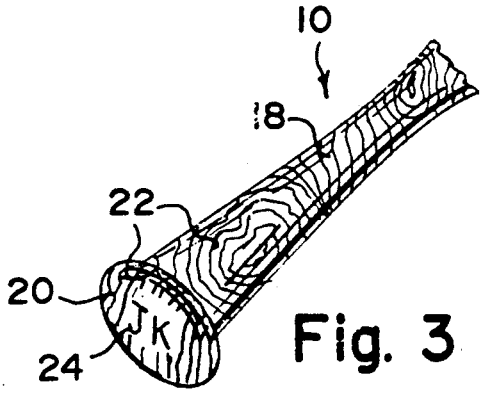
FIG. 3 is a perspective view of the bottom of the handle with initials of the owner engraved therein.

Turning now descriptively to the drawings, in which like reference characters denote like elements throughout the several views, the figures illustrate a combination bat and umbrella 10 which consists of a collapsible canopy 12 and a central rod 14 extending from the canopy 12. A simulated baseball bat end 16 is affixed to the top of the canopy 12. A simulated baseball bat handle 18 is affixed to the bottom of the central rod 14. When the canopy 12 is opened a person can comfortably grip the simulated baseball bat handle 18 to position the canopy 12 over themselves. When the canopy 12 is closed it will look like a simulated baseball bat barrel to complete a simulated baseball bat configuration which can be used to ward off muggers and attackers.

The combination bat and umbrella further includes a knob 20 on the bottom end of the simulated baseball bat handle 18 to prevent slippage when the person grips the simulated baseball bat handle 18. The combination bat and umbrella further includes a wood pattern camouflage 22 disposed onto the canopy 12, with a simulated baseball bat end 16, simulated baseball bat handle 18 and the knob 20 to enhance the appearance of the simulated baseball bat when the canopy 12 is closed.

Indicia 24, such as the initials of the person, may be placed onto the bottom of the knob 20 to be used for identification thereof. The simulated baseball bat handle 18 and knob 20 can be fabricated out of wood, plastic or lightweight metal. The wood pattern camouflage 22 can be substituted by utilizing solid basic colors, such as tan or black, that are used on baseball bats. The collapsible canopy 12 and central rod 14 are the same as for a regular type of umbrella while the simulated baseball handle 18 attached to the central rod 14 can extend about ten to twelve inches for best results.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination bat and umbrella which comprises:

a) a collapsible canopy;

b) a central rod extending from said canopy;

c) a simulated baseball bat end affixed to the top of said canopy; and d) a simulated baseball bat handle affixed to the bottom of said central rod, the canopy, bat end and bat handle being of similar coloring so that when said canopy is opened a person can comfortable grip said simulated baseball bat handle to position said canopy over themselves and when said canopy is closed it will extend externally between the bat end and the bat handle whereby said canopy simulates a baseball bat barrel; and wherein the cooperation of said canopy, bat end and bat handle forms baseball barrel to a simulated baseball bat configuration which can be used to ward off muggers and attackers.

2. A combination bat and umbrella as recited to claim 1, further including a knob formed on the bottom of said simulated baseball bat handle to prevent slippage when the person grips said simulated baseball bat handle.

3. A combination bat and umbrella as recited in claim 2, in which the coloring is a wood pattern camouflage disposed onto said canopy, said simulated baseball bat end, said simulated baseball bat handle and said knob to enhance the appearance of the simulated baseball bat when said canopy is closed.

4. A combination bat and umbrella as recited in claim 3, further including indicia placed onto the bottom of said knob to be used for identification thereof.

* * * * *